US011761726B1

(12) United States Patent
Duquette

(10) Patent No.: US 11,761,726 B1
(45) Date of Patent: Sep. 19, 2023

(54) GUN BARREL CLEANING APPARATUS AND METHODS

(71) Applicant: Daniel L. Duquette, Tustin, CA (US)

(72) Inventor: Daniel L. Duquette, Tustin, CA (US)

( * ) Notice: Subject to any disclaimer, the term of this patent is extended or adjusted under 35 U.S.C. 154(b) by 0 days.

(21) Appl. No.: 17/477,564

(22) Filed: Sep. 17, 2021

(51) Int. Cl.
*F41A 29/02* (2006.01)

(52) U.S. Cl.
CPC ..... *F41A 29/02* (2013.01)

(58) Field of Classification Search
CPC ..... F41A 29/02; F41A 35/00; F41A 29/00; B08B 9/00; B08B 2209/04; B08B 9/0436; B25H 3/021; B65D 50/04; F41C 27/00; F41C 33/00
USPC ..... 42/95; 102/442
See application file for complete search history.

(56) References Cited

U.S. PATENT DOCUMENTS 3,602,935 A * 9/1971 McDonnell ..... F41A 29/02 42/95
3,765,045 A * 10/1973 Schneider ..... F41A 29/00 15/104.18
4,873,778 A * 10/1989 Stipp ..... F41A 29/02 42/95
5,557,871 A * 9/1996 LaLonde ..... A46B 3/18 15/207.2
8,695,264 B1 * 4/2014 Blackburn ..... F41A 29/02 42/95
9,505,039 B1 * 11/2016 Green ..... B08B 9/00
9,631,894 B2 * 4/2017 Leslie ..... F41C 23/10
2006/0005446 A1 * 1/2006 Lee ..... F41C 9/08 42/90
2016/0161213 A1 * 6/2016 Leslie ..... F41C 23/10 42/71.01
2021/0190454 A1 * 6/2021 Hoodecheck ..... F41A 29/02
2022/0146228 A1 * 5/2022 Hoodecheck ..... F41A 29/02

* cited by examiner

*Primary Examiner* — Michael D David
(74) *Attorney, Agent, or Firm* — Patent Law & Venture Group LLC; Gene Scott

(57) ABSTRACT

An apparatus and method for cleaning gun barrels includes a first tube and a second tube, the tubes engaged coaxially with a smaller one of the tubes inserted within the larger one. The tube wall of each tube has an axially oriented slot which is open to one end of the tube and extends along the tube wall. The smaller tube receives a gun barrel axially with its gun sight or other appurtenance protruding through the slot. A gun sight or other integral appurtenance of the gun barrel extends through the slots of both tubes resting in a wider portion of the smaller tube so that the gun barrel is locked in place. A gun cleaning rod is able to be axially aligned through the tubes and the gun barrel. The method includes using a barrel cleaning brush attached at one end of the gun cleaning rod so that it is able to be moved reciprocally within the bore of the gun barrel. Gun cleaning solvent on the brush dissolves residue within the barrel and tends to spray as the brush enters and exits the barrel. However, over-spray of the solvent is captured by the tubes enabling a fastidious gun barrel cleaning process.

9 Claims, 4 Drawing Sheets

GUN BARREL CLEANING APPARATUS AND METHODS

FIELD OF THE DISCLOSURE OF THE TITLED INVENTION

The described invention relates to pistol gun barrel cleaning apparatus and methods and more particularly to a method that avoids splatter and splash of cleaning fluids and oils.

BACKGROUND OF THE INVENTION

The present invention is related to known apparatus and methods of use in the field, but is not disclosed in the composite prior art literature in a manner that would render the subject as lacking novelty or of being anticipated. The following documents represent the current state of the art. US2012/0124883 discloses an apparatus for cleaning the bore of a firearm barrel and includes an elongated flexible pull cord having a handle on a first end and a cleaning head on a second end. US20060277811 discloses a gun barrel cleaning device including a quick-detachable coupling mechanism releasably coupling a handle to a cleaning implement for cleaning a gun barrel bore. A novel sheath for storing a gun barrel bore-cleaning implement is also disclosed. US 2014/0123529 discloses a device for cleaning the barrel of a firearm comprising a longitudinal central member having a leading end and a trailing end; a tubular woven sheath surrounding the central member, and a radial protrusion formed of a polymer disposed about the central member and under the tubular woven sheath. U.S. Pat. No. 2,559,376 discloses a cleaning brush and one or more lubricating and sealing rolls wherein they may be easily and quickly renewed after they have become worn. U.S. Pat. No. 1,745,575 discloses an improved cleaner or scrubber by means of which the bores of firearms may be quickly, thoroughly, and properly cleaned and lubricated without the liability or danger of scratching or mutilating the gun. A novel sheath for storing a gun barrel bore-cleaning implement is also disclosed. U.S. Pat. No. 9,366,496 discloses systems and methods for cleaning implements for firearms. In one embodiment, a cleaning implement may include a distal end, a proximal end, and a shaft extending between the ends, the shaft configured to be coupled to a cleaning rod. U.S. Pat. No. 5,934,000 discloses a gun barrel cleaner for cleaning the bore of a firearm without danger of contaminating the breech. US2005/0252405 discloses a firearm barrel cleaning shell including a casing carrying a primer at one of its ends and having an opening at the other of its ends. CN104544509 discloses a hollow cylinder, and a filter block with filter components installed in the hollow cylinder. U.S. Pat. No. 8,950,032 discloses a novel cleaning tool with a net-like carrier wound on an inner cylinder. This literature relates to the presently described invention.

SUMMARY OF THE INVENTION

The process of cleaning a gun bore involves the use of strong solvents, therefore a person carrying out such a process should wear rubber gloves, use eye protection, and make sure there is adequate ventilation. One object of the invention is to restrict solvent overspray. A further object of the invention is to assure as much as possible that solvent soaked patches and wipes do not come into contact with personnel including skin contact and especially inhalation. A still further object of the invention is to provide a simple and low cost apparatus and procedure that is easily learned and able to be safely carried out.

The apparatus used in the present invention procedure may include a pair of rigid or semi rigid tubes of a material that is resistant to gun cleaning solvents. The two tubes are of such relative diameters that a smaller of the two fits inside a larger of the two in a coaxial sliding and mutually rotational relationship. The smaller tube has an inside diameter sufficient for receiving a gun barrel to be cleaned. One end of each of the two tubes has an axially aligned "slot" cut through its wall, the slot being just wide enough to accept a gun sight or other exterior outcropping of the gun barrel with the slot of the smaller of the two tubes terminating at a relatively wider portion. With the gun barrel inserted into the smaller tube, the outcropping protrudes through the slot to a position beyond the outside diameter of the smaller tube. With the slots of the two tubes aligned, the outcropping also extends into and through the slot of the larger tube. The gun barrel is moved axially through the smaller tube until the outcropping enters the wider portion of the smaller tube's slot whereupon the larger tube may be rotated so that the sidewall of the larger tube's slot pushes the outcropping rotationally wherein the outcropping is moved within the wider portion of the smaller tube's slot thereby locking the gun barrel so that it is not able to move axially since the outcropping is no longer aligned with the initial portion of the slot. Because the two tubes are frictionally engaged, the position of the larger tube's slot prevents the gun barrel from rotating within the smaller tube.

The larger tube may have a cap on its proximal end, the cap having an axially aligned aperture sufficient in diameter to accept a gun cleaning rod which is used to clean the bore of the gun barrel. The cleaning process is initiated by inserting the distal end of the cleaning rod through the cap's aperture and then affixing a cleaning tool such as a bore brush (dipped in cleaning solution) to its distal end. After, the cleaning tool is inserted into the gun bore and the two tubes are joined as previously discussed, the cleaning rod is then pumped through the gun bore for cleaning action. A centering ring may be placed within the smaller tube in order to maintain axial alignment of the rod. The foregoing method may be repeated to assure bore cleanliness. Finally, the tubes may be separated enabling the rod to be fitted with a patch holder and patch(s) to clean-up the gun bore. Finally the bore may be lubricated using patches in the same way. The patches may be accumulated in the distal end of the smaller tube and when the bore conditioning steps are finished, the rod may be used to push the patches into a waste receptacle, eliminating the need for manual contact. Finally, the clean and conditioned gun barrel may be removed from the small tube by reversing the initial steps of its insertion and locking in place.

In this disclosure, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE ASSOCIATED DRAWINGS

Embodiments of the described apparatus are illustrated only as examples in the drawing figures accompanying the written description. Alpha-numerical call-outs are used to identify elements of the invention, wherein the same call-out refers to the same element as it may appear in the accompanying figures, wherein.

DETAILED DESCRIPTION OF THE INVENTION

Figure 1:
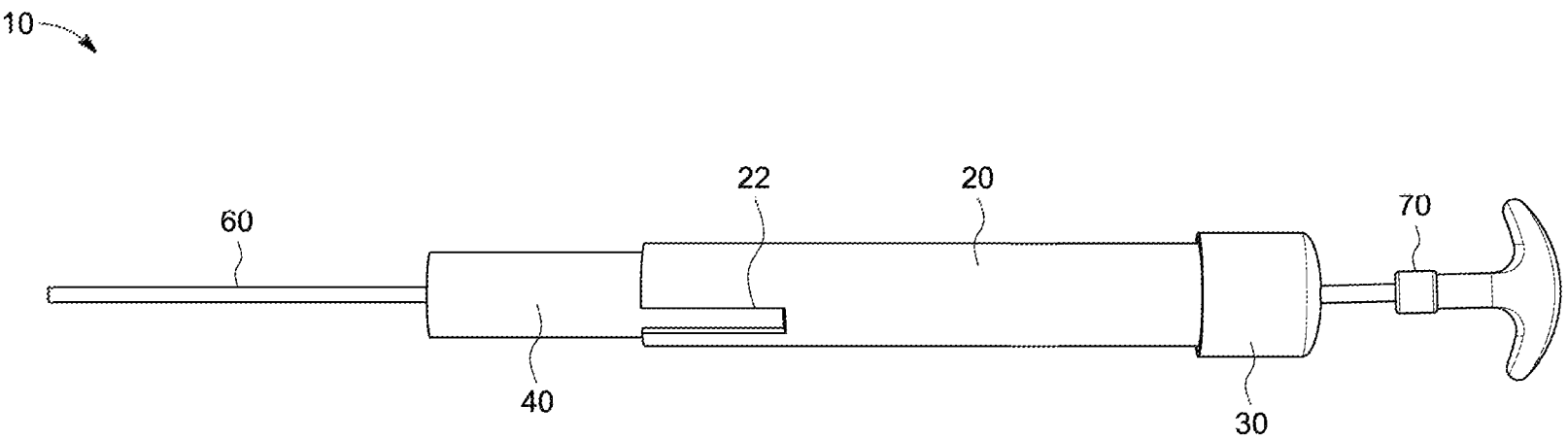
FIG. 1 is a plan view of an embodiment of the described invention.

The present invention is now described in detail referring to the attached drawing figures. FIG. 1 illustrates the invention 10 as in one possible use. In this figure first tube 20, first slot 22 in a distal end of first tube 20, cap 30 mounted on a proximal end of first tube 20, second tube 40, gun barrel 50, gun cleaning rod 60, and rod handle 70 are illustrated. First tube 20 and second tube 40 are engaged in a mutual coaxial relationship wherein tubes 20 and 40 are able to slide axially and also rotate relative to each other. Rod 60 is able to be placed axially within tubes 20 and 40 as shown and is free to operate reciprocal linear action therein.

Figure 2:
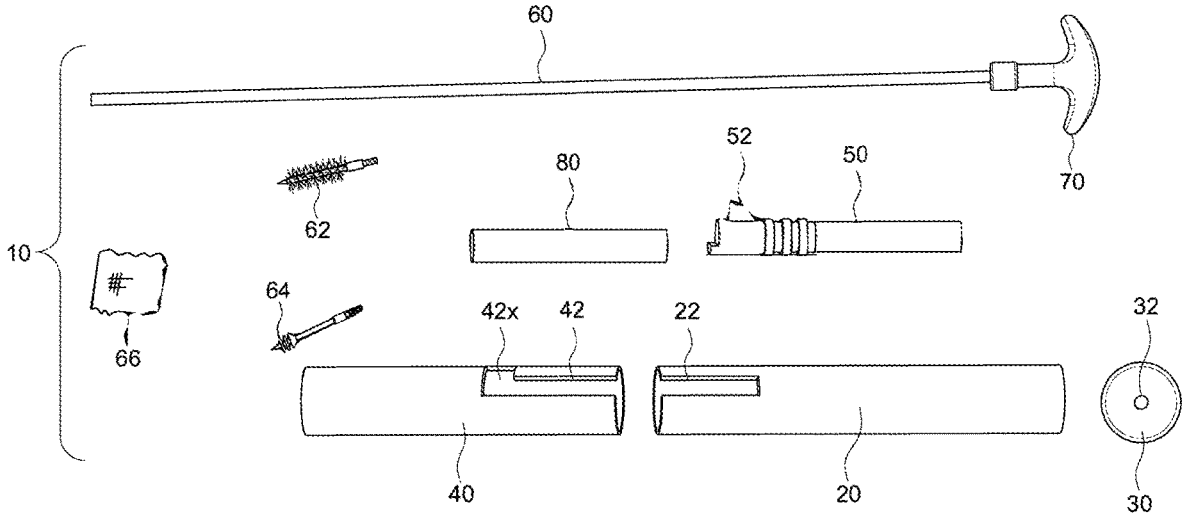
FIG. 2 is a plan view of the elements thereof.

FIG. 2 illustrates separate disassembled elements of invention 10. In this figure first tube 20, first slot 22, cap 30, cap aperture 32, second tube 40, slot 42, slot extension 42X, gun barrel 50, gun barrel sight 52, cleaning rod 60, handle 70, brush 62, patch tool 64, and patch 66, and centering ring 80 are illustrated.

Figure 3:
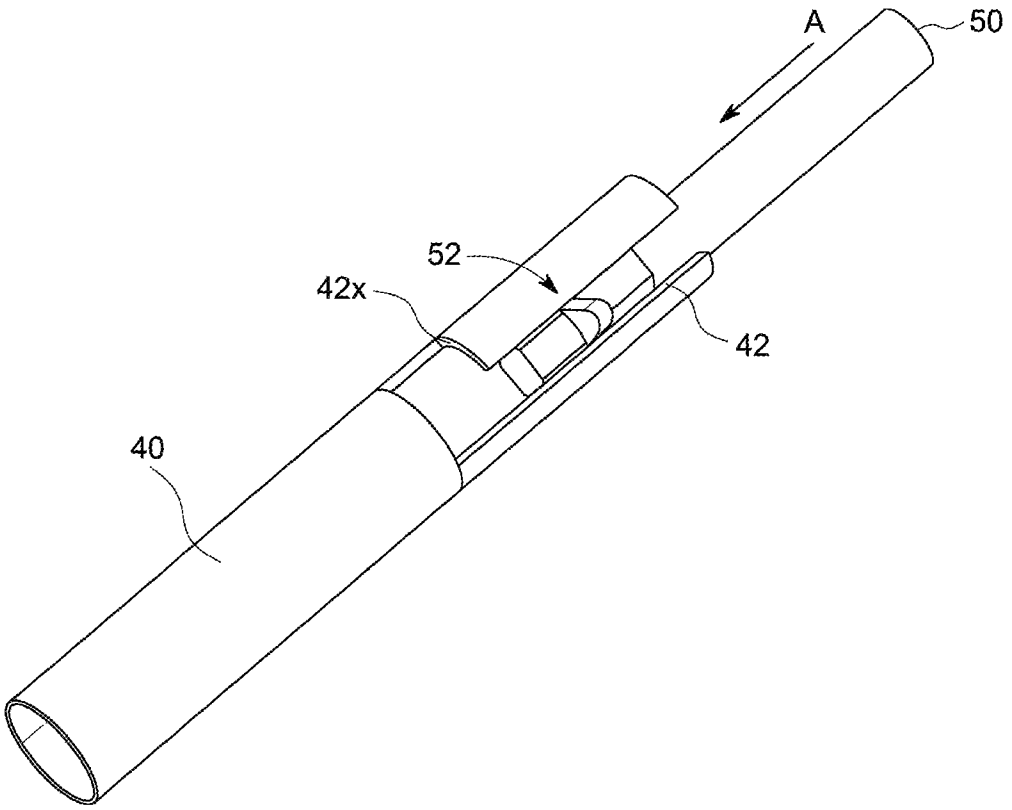
FIGS. 3 and 4 are perspective views of a tube of the invention showing progressive gun barrel insertions therein.
Figure 4:
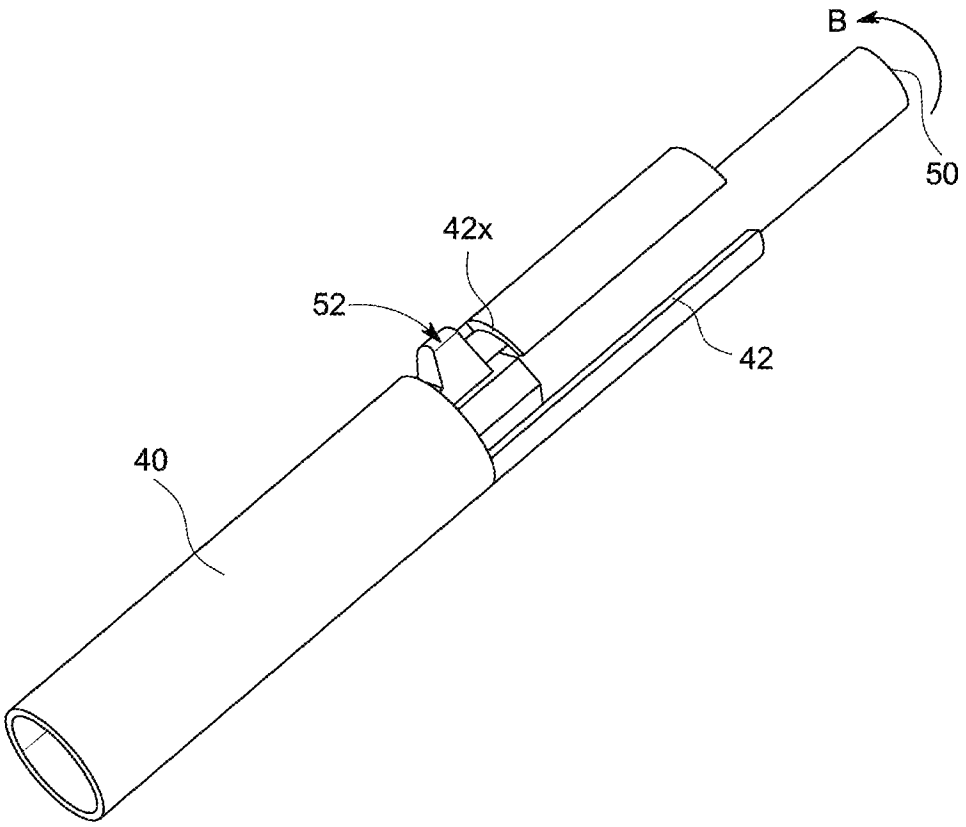

The manner of assembly of the elements shown in FIG. 2 is now described such that the final working apparatus shown in FIG. 1 is achieved. FIG. 3 illustrates gun barrel 50 being pushed into slot 42 of second tube 40 and FIG. 4 shows gun barrel 50 fully inserted into slot 42 and rotated such that outcropping 52 is locked in place within slot extension 42X. In this description "gun barrel sight" may refer to an actual gun sight that is an integral part of gun barrel 50, but "gun barrel sight" may also refer to any appurtenance or outcropping that may be integral to gun barrel 50. The term "slot" in this description refers to a partial opening in the wall of a tube 20 or 40. Slots 22 and 42 may be axially aligned as shown and may be extensive to a position in the respective tubes as shown.

An inside diameter of second tube 40 is sufficient for receiving gun barrel 50 with slot 42 sufficient in width for receiving outcropping 52. Slot extension 42X is circumferentially offset with respect to slot 42. Axially aligned first slot 42 of first tube 20 may be extensive from a distal end of first tube 40. First slot 22 is sufficient in width for receiving outcropping 52. Centering ring 80 may be engaged within second tube 40. Cap 30 may be frictionally engaged with the proximal end of first tube 20 wherein cap 30 may have an axially positioned aperture 32 therein. Aperture 32 may be adapted by its diameter dimension and length for receiving and supporting gun cleaning rod 60 so it is axially aligned and positioned relative to cap 30, centering ring 80, and first 20 and second 40 tubes.

Methods for cleaning gun barrel 50 include the steps:

1. Engaging outcropping 52 of barrel 50 with second slot 42 and pushing barrel 50 into slot 42 until it is fully inserted;
2. Engaging cap 30 on the proximal end of tube 20;
3. Pushing rod 30 through aperture 32 and tube 20;
4. Attaching brush 62 to the distal end of rod 60;
5. Optionally Inserting brush 62 through centering ring 80;
6. Pushing brush 62 into the proximal end of the bore of gun barrel 50;
7. Engaging tube 20 with tube 40 aligning slots 22 and 42 until slot 22 engages outcropping 52;
8. Rotating first tube 20 to force gun barrel outcropping 52 into slot extension 42X thereby locking gun barrel 50 in position on second tube 40;
9. Reciprocating rod 60 to force brush 62 through the gun barrel bore for cleaning action;
10. Repeating the previous steps substituting patch holder 64 for brush 62 and using a series of patches 66 for cleaning and lubricating the bore of gun barrel 50; and
11. Push all patches out of the distal open end of tube 40.

In the foregoing description; embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. An apparatus for cleaning a bore of a gun barrel wherein said gun barrel has an external outcropping, said apparatus comprising:

a first tube and a second tube, said tubes mutually engaged in a coaxial relationship with said second tube within said first tube;

axially aligned slots extensive from open ends of said tubes;

an inside diameter of said second tube sufficient for receiving said gun barrel with said axially aligned slot thereof of sufficient size for receiving said outcropping;

said axially aligned slot of said first tube of sufficient size for receiving said outcropping.

2. The apparatus of claim 1 wherein said axially aligned slot of said second tube is integral with an extension portion of said first tube.

3. The apparatus of claim 1 further comprising a centering ring.

4. The apparatus of claim 1 further comprising a cap and a gun cleaning rod engaged with said first tube.

5. The apparatus of claim 4 wherein said cap has an aperture adapted for receiving a said gun cleaning rod.

6. The apparatus of claim 5 wherein said gun cleaning rod is positioned axially relative to said cap and said tubes.

7. The apparatus of claim 6 wherein said gun cleaning rod is positioned axially relative to said cap, a centering ring and said tubes.

8. A method for cleaning a gun barrel, said method comprising:

a first tube and second tube, each tube with a slot;

engaging an external outcropping of said barrel with a slot and pushing said barrel into said slot until fully inserted;

engaging a cap with an aperture, on a proximal end of one of said tubes;

pushing a rod through said aperture and said tube;

attaching a brush to a distal end of said rod;

inserting said brush through a centering ring;

pushing said brush into a proximal end of a bore of said gun barrel;

engaging one of said tubes with another of said tubes aligning said slots of said tubes until said slots engage said outcropping;

rotating one said tube to force said gun barrel outcropping into a slot extension thereby locking said gun barrel in position on said second tube; and reciprocating said rod to force said brush through said barrel bore for cleaning action.

9. The method of claim 8 further comprising repeating the steps of claim 8 while substituting a patch holder for said brush and using a series of patches for cleaning and lubricating said bore of said gun barrel; and pushing all said patches out of said tube.

* * * * *